US009172180B2

(12) United States Patent
Harvey

(10) Patent No.: US 9,172,180 B2
(45) Date of Patent: Oct. 27, 2015

(54) CANALPHONE COUPLER SYSTEM AND METHOD

(71) Applicant: Jerry Harvey, Apopka, FL (US)

(72) Inventor: Jerry Harvey, Apopka, FL (US)

( * ) Notice: Subject to any disclaimer, the term of this patent is extended or adjusted under 35 U.S.C. 154(b) by 0 days.

(21) Appl. No.: 14/246,043

(22) Filed: Apr. 5, 2014

(65) Prior Publication Data

US 2014/0301768 A1 Oct. 9, 2014

Related U.S. Application Data

(60) Provisional application No. 61/808,996, filed on Apr. 5, 2013.

(51) Int. Cl.

| | |
|---|---|
| ***H01R 13/622*** | (2006.01) |
| *H01R 24/86* | (2011.01) |
| *H01R 107/00* | (2006.01) |

(52) U.S. Cl.

CPC ..... *H01R 13/622* (2013.01); *H01R 24/86* (2013.01); *H01R 2107/00* (2013.01); *Y10T 29/49005* (2015.01); *Y10T 403/1616* (2015.01); *Y10T 403/70* (2015.01)

(58) Field of Classification Search

CPC ..... H04R 1/1016
USPC ..... 381/380, 312, 328; 403/13, 315
See application file for complete search history.

(56) References Cited

U.S. PATENT DOCUMENTS

| | | | | |
|---|---|---|---|---|
| 4,742,887 | A | 5/1988 | Yamagishi | |
| 7,194,102 | B2 | 3/2007 | Harvey | |
| 7,194,103 | B2 | 3/2007 | Harvey | |
| 7,263,195 | B2 | 8/2007 | Harvey | |
| 7,310,427 | B2 * | 12/2007 | Retchin et al. | 381/380 |
| 7,317,806 | B2 | 1/2008 | Harvey | |
| 7,489,794 | B2 | 2/2009 | Harvey | |
| 7,634,099 | B2 | 12/2009 | Harvey | |
| 7,672,469 | B2 | 3/2010 | Harvey | |
| 7,864,975 | B2 | 1/2011 | Harvey | |
| 7,869,616 | B2 | 1/2011 | Harvey | |
| 7,876,920 | B2 | 1/2011 | Harvey | |
| 7,876,921 | B2 | 1/2011 | Harvey | |
| 8,391,535 | B1 | 3/2013 | Harvey | |
| 2006/0133632 | A1 * | 6/2006 | Dyer et al. | 381/312 |
| 2006/0222185 | A1 | 10/2006 | Harvey | |
| 2007/0201717 | A1 | 8/2007 | Harvey | |
| 2007/0223735 | A1 | 9/2007 | LoPresti et al. | |
| 2008/0181443 | A1 | 7/2008 | Harvey | |
| 2009/0041262 | A1 | 2/2009 | Harvey | |
| 2011/0293112 | A1 | 12/2011 | Harvey | |
| 2012/0237046 | A1 | 9/2012 | Yamkovoy | |
| 2013/0048415 | A1 | 2/2013 | de Lima | |

* cited by examiner

*Primary Examiner* — Daniel Wiley
(74) *Attorney, Agent, or Firm* — Douglas J Visnius

(57) ABSTRACT

A canalphone system may include a canalphone coupler, and four connectors carried by the canalphone coupler of which at least two of the four connectors carry an acoustical signal. The system may also include a mechanical joint that joins the canalphone coupler to a cable where the mechanical joint is assembled and disassembled by a user.

16 Claims, 17 Drawing Sheets

CANALPHONE COUPLER SYSTEM AND METHOD

CROSS-REFERENCE TO RELATED APPLICATIONS

This application claims the benefit of U.S. Provisional Application No. 61/808,996, filed 5 Apr. 2013. This application and the application identified above include identical inventorship and ownership.

BACKGROUND

The embodiments relate to the field of canalphones.

There are many different types of personal listening devices such as headphones, earbuds, canalphones, and/or the like. Headphones are personal listening devices that are held in close proximately to the ear by some support system. Earbuds are small personal listening devices that are positioned directly in front of the ear canal and are substantially smaller than a person's outer ear. Similarly, canalphones are personal listening devices that are substantially smaller than a person's outer ear, but they differ from earbuds in that they are placed directly in one end of the ear canal. Both earbuds and canalphones are held in positioned by friction between the ear and the device rather than the support system found in most headphones.

Canalphones are also referred to as in-ear monitors due to how the canalphone is worn by a listener. In other words, a canalphone housing is worn in the ear of the user and not over and/or around the ear of the user. Some canalphones also serve as earplugs due to the way the canalphone limits noise external to the canalphone from entering the ear canal.

SUMMARY

According to an embodiment, a canalphone system may include a canalphone coupler, and four connectors carried by the canalphone coupler of which at least two of the four connectors carry an acoustical signal. The system may also include a mechanical joint that joins the canalphone coupler to a cable where the mechanical joint is assembled and disassembled by a user.

The system may further include a locator carried by the mechanical joint that properly positions the four connectors during mating with the cable. One of the four connectors may comprise a ground connector, one of the four connectors may comprise a low connector, and at least two of the four connectors may comprise a mid connector, a high connector, and a microphone connector.

The mid connector may be bonded to the high connector. The four connectors may be recessed into the canalphone coupler. The mechanical joint may not rely on any of the four connectors to join the canalphone coupler to the cable.

The system may additionally include an attenuator in communication with at least one of the low connector, the mid connector, and the high connector. The attenuator may be added or removed by the user.

The attenuator may be adjustable by the user. The attenuator may be adjustable between 0-25 decibels for the low connector, and 0-15 decibels for the mid connector and the high connector.

In an alternative embodiment, the system may include a canalphone coupler, and four connectors carried by the canalphone coupler of which at least two of the four connectors carry an acoustical signal, and where one of the four connectors comprises a ground connector, one of the four connectors comprises a low connector, and where at least two of the four connectors comprise a mid connector, a high connector, and a microphone connector. The system may also include a mechanical joint that joins the canalphone coupler to a cable where the mechanical joint is assembled and disassembled by a user. The system may further include an attenuator in communication with at least one of the low connector, the mid connector, and the high connector.

Another aspect is a method that may include carrying an acoustical signal with at least two of four connectors carried by a canalphone coupler. The method may also include joining the canalphone coupler to a cable by a mechanical joint that is assembled and disassembled by a user.

The method may further include properly positioning the four connectors during mating with the cable via a locator. The method may additionally include connecting an attenuator to at least one of the four connectors. The method may also include making the attenuator adjustable by the user.

DETAILED DESCRIPTION

Embodiments will now be described more fully hereinafter with reference to the accompanying drawings, in which preferred embodiments are shown. Like numbers refer to like elements throughout, like numbers with letter suffixes are used to identify similar parts in a single embodiment, and letter suffix lower case n is a variable that indicates an unlimited number of similar elements.

Figure 1:
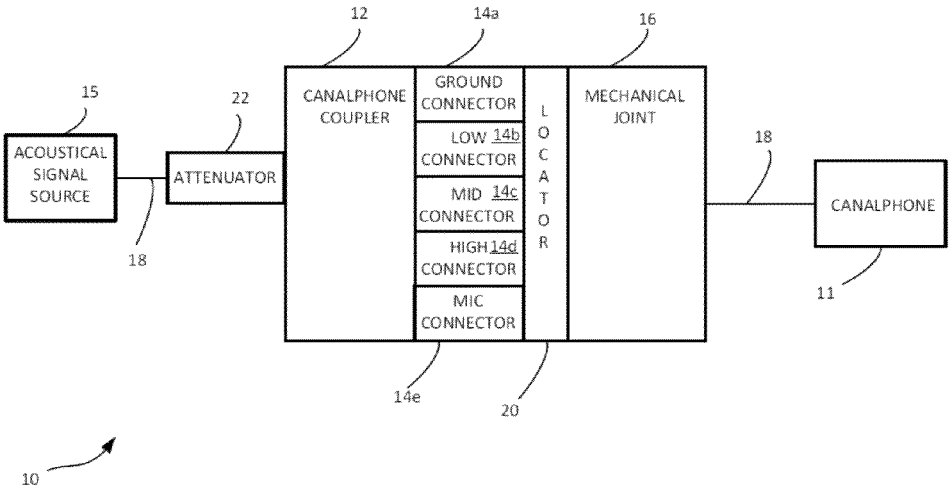
FIG. 1 is a schematic block diagram of a system in accordance with the embodiments.
Figure 2:
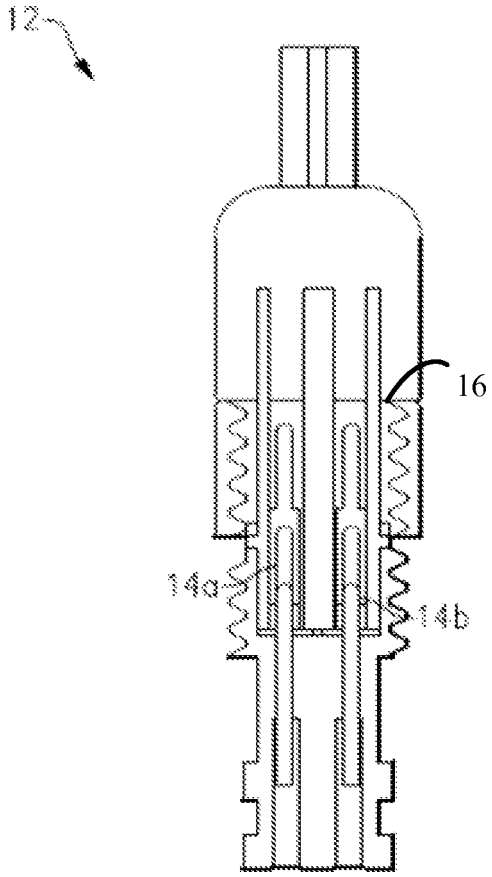
FIG. 2 is an embodiment of the canalphone coupler of FIG. 1.
Figure 3:
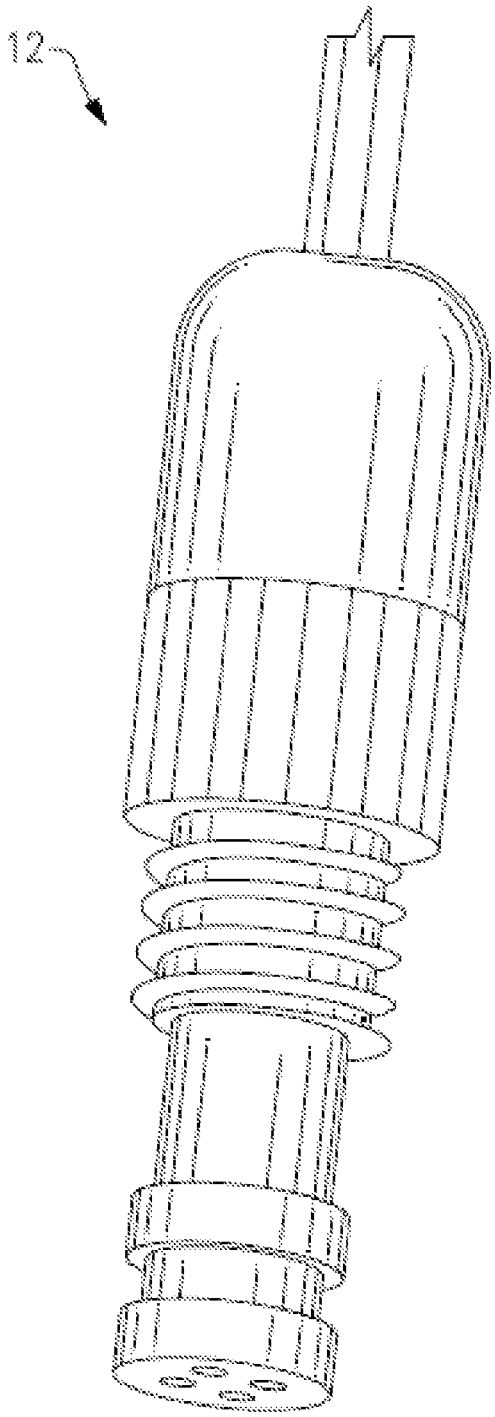
FIG. 3 is an embodiment of the canalphone coupler of FIG. 1.
Figure 4:
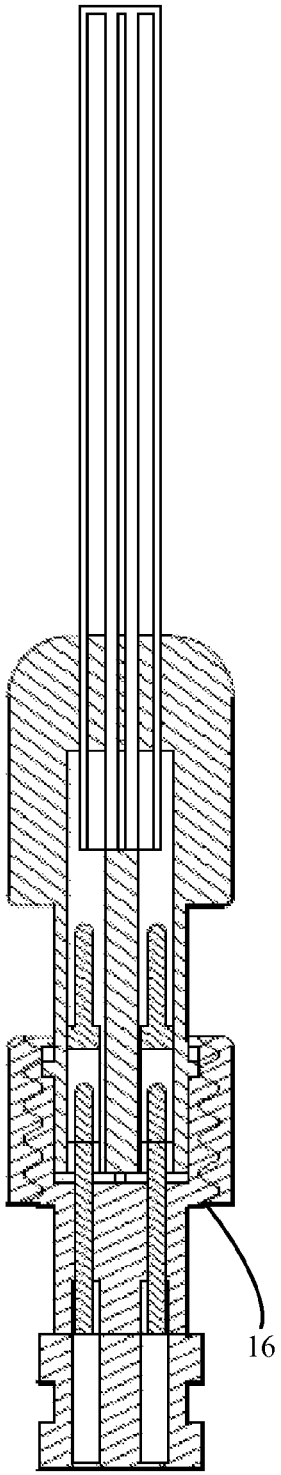
FIG. 4 is an embodiment of the canalphone coupler of FIG. 1.

With reference now to FIG. 1, a canalphone system 10 is initially described. In one embodiment, the system 10 includes a canalphone coupler 12, and four connectors 14*a*-14*n* carried by the canalphone coupler of which at least two of the four connectors carry an acoustical signal. The acoustical signal is analog, digital, optical, electrical, and/or the like, for example. The four connectors 14*a*-14*n* comprise electrical contacts, electrical connectors, optical connectors, audio connectors, and/or the like, for instance. The system 10 also includes a mechanical joint 16 that joins the canalphone coupler 12 to a cable 18 where the mechanical joint is assembled and/or disassembled by a user (not shown). The cable 18 is connected to a canalphone 11 and/or an acoustical signal source 15, for example.

The mechanical joint 16 is temporary, semi-permanent (needs a tool and/or more effort to undo than the temporary version), and/or permanent, for instance. The mechanical joint 16 comprises a screw joint, snap fit assembly, retaining ring assembly, annular locks, and/or the like, for example. In one embodiment, the mechanical joint 16 includes a knurled section to aid user assembly and/or disassembly.

In one embodiment, the system 10 further includes a locator 20 carried by the mechanical joint 16 that properly positions the four connectors 14*a*-14*n* during mating with the cable 18. For example, the locator 20 comprises a keyed joint, mated splines, a Hirth joint, and/or the like.

In one embodiment, one of the four connectors 14*a*-14*n* comprises a ground connector 14*a*, one of the four connector comprises a low connector 14*b*, and at least two of the fours connector comprise a mid connector 14*c*, a high connector 14*d*, and a microphone connector 14*e*. In another embodiment, the low connector 14*b* carries a low frequency portion of the acoustical signal, the mid connector 14*c* carries a mid frequency portion of the acoustical signal, the high connector 14*d* carries a high frequency portion of the acoustical signal, and/or the microphone connector 14*e* carries the microphone portion of the acoustical signal.

In one embodiment, the mid connector 14*c* is bonded to the high connector 14*d*. In other words, there is a ground connector 14*a*, a low connector 14*b*, a mid connector/high connector 14*c*/14*d*, and a microphone connector 14*e*, for instance. In another embodiment, the four connectors 14*a*-14*n* are recessed into the canalphone coupler 12 to aid in protecting the four connectors 14*a*-14*n*.

In one embodiment, the mechanical joint 16 does not rely on any of the four connector 14*a*-14*n* to join the canalphone coupler 12 to the cable 18. Stated another way, the mechanical joint 16 holds the canalphone coupler 12 to the cable 18 without any aid from the four connectors 14*a*-14*n*. In another embodiment, the four connectors 14*a*-14*n* do aid the mechanical joint 16 in holding the canalphone coupler 12 to the cable 18.

In one embodiment, the system 10 additionally includes an attenuator 22 in communication with at least one of the low connector 14*b*, the mid connector 14*c*, and the high connector 14*d*. The attenuator 22 is passive, active, balanced, unbalanced, and/or the like, for example. In another embodiment, the attenuator 22 is carried by the canalphone coupler 12 and/or the cable 18.

In one embodiment, the attenuator 22 is added or removed by the user. In other words, system 10 works with or without the attenuator 22.

In one embodiment, the attenuator is adjustable by the user. For example, the attenuator 22 is adjustable to provide an attenuation of the acoustical signal between 0-25 decibels for the low connector 14*b*, and 0-15 decibels for the mid connector 14*c* and the high connector 14*d*.

In an alternative embodiment, the system 10 includes a canalphone coupler 12, and four connectors 14*a*-14*n* carried by the canalphone coupler of which at least two of the four connectors carry an acoustical signal, and where one of the four connectors comprises a ground connector 14*a*, one of the four connectors comprises a low connector 14*b*, and where at least two of the four connectors comprise a mid connector 14*c*, a high connector 14*d*, and a microphone connector 14*e*. The system 10 also includes a mechanical joint 16 that joins the canalphone coupler 12 to a cable 18 where the mechanical joint is assembled and disassembled by a user. The system 10 further includes an attenuator 22 in communication with at least one of the low connector 14*b*, the mid connector 14*c*, and the high connector 14*d*.

Figure 5:
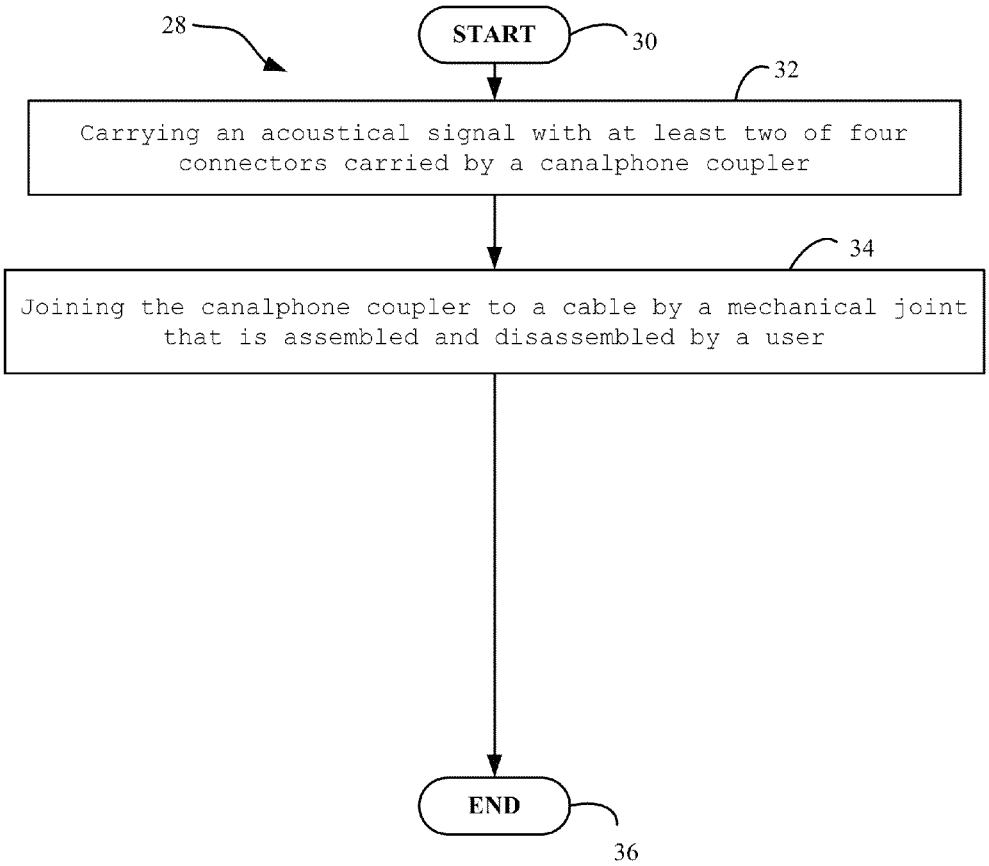
FIG. 5 is a flowchart illustrating method aspects according to various embodiments.

Another aspect is a method, which is now described with reference to flowchart 28 of FIG. 5. The method begins at Block 30 and may include carrying an acoustical signal with at least two of four connectors carried by a canalphone coupler at Block 32. The method may also include joining the canalphone coupler to a cable by a mechanical joint that is assembled and disassembled by a user at Block 34. The method ends at Block 36.

Figure 6:
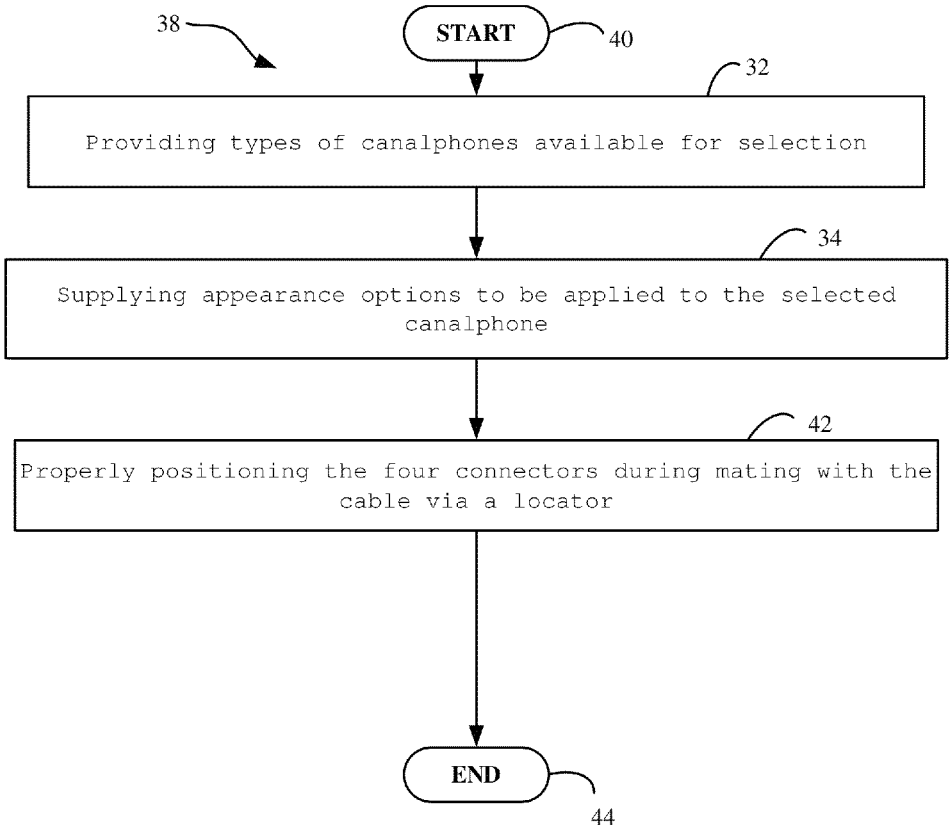
FIG. 6 is a flowchart illustrating method aspects according to the method of FIG. 5.

In another method embodiment, which is now described with reference to flowchart 38 of FIG. 6, the method begins at Block 40. The method may include the steps of FIG. 5 at Blocks 32 and 34. The method may further include properly positioning the four connectors during mating with the cable via a locator at Block 42. The method ends at Block 44.

Figure 7:
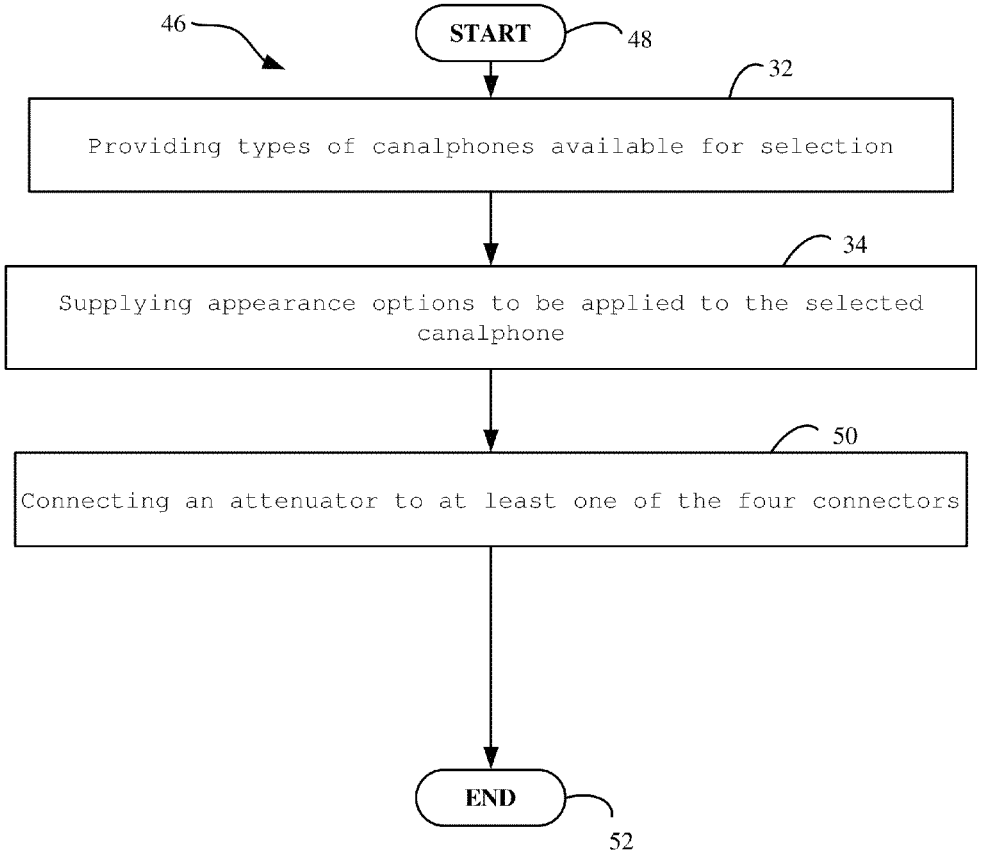
FIG. 7 is a flowchart illustrating method aspects according to the method of FIG. 5.

In another method embodiment, which is now described with reference to flowchart 46 of FIG. 7, the method begins at Block 48. The method may include the steps of FIG. 5 at Blocks 32 and 34. The method may additionally include connecting an attenuator to at least one of the four connectors at Block 50. The method ends at Block 52.

Figure 8:
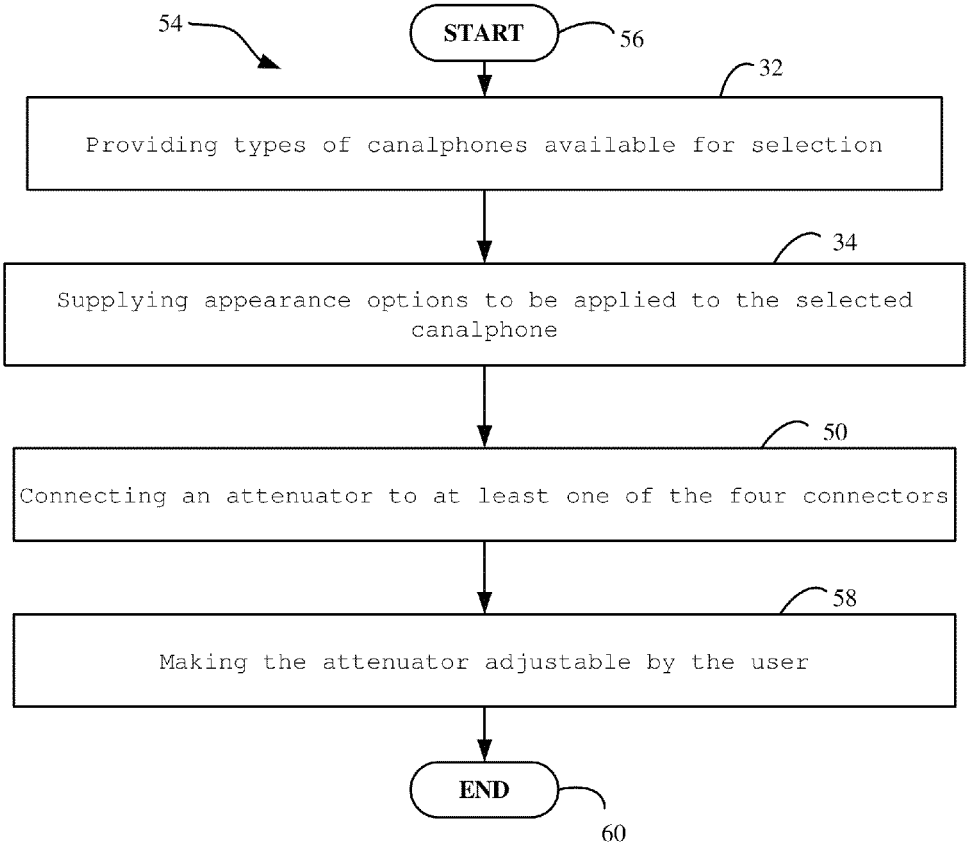
FIG. 8 is a flowchart illustrating method aspects according to the method of FIG. 7.
Figure 9:
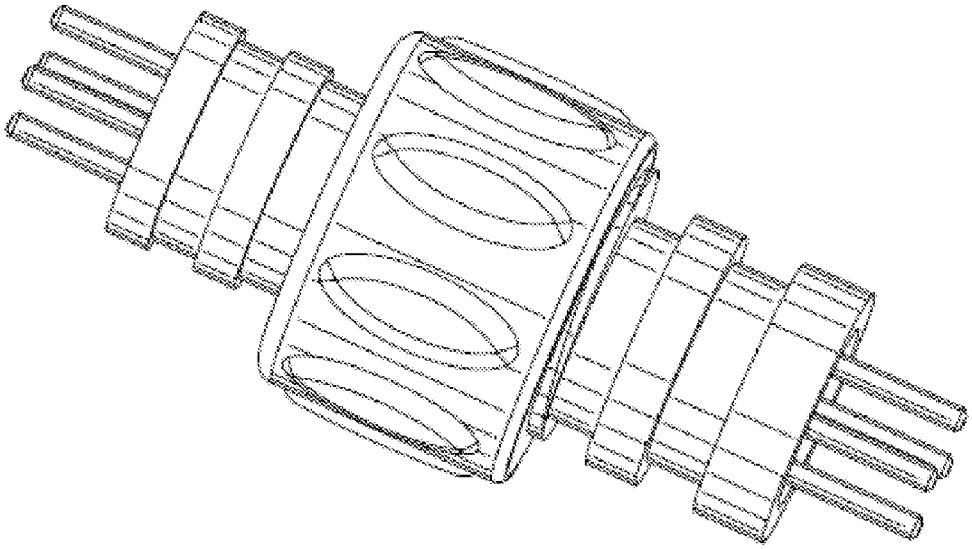
FIG. 9 is an embodiment of the canalphone coupler of FIG. 1.
Figure 10:
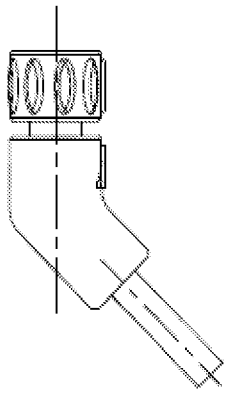
FIGS. 10-12 are female portions of an embodiment of the canalphone coupler of FIG. 1.
Figure 11:
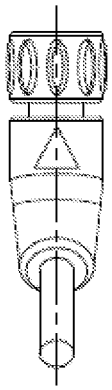
Figure 12:
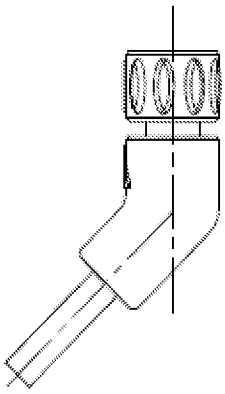
Figure 13:
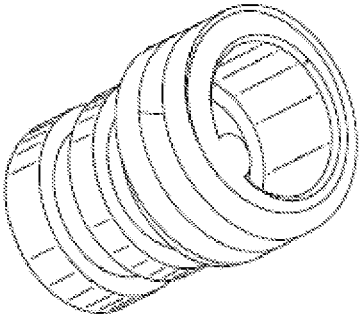
FIG. 13 is a male portion an embodiment of the canalphone coupler of FIG. 1.
Figure 14:
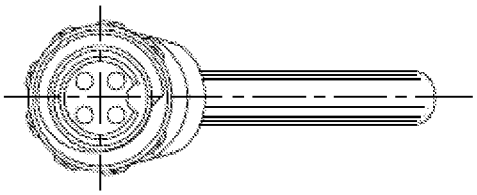
FIGS. 14-17 are female portions of an embodiment of the of the canalphone coupler of FIG. 1.
Figure 15:
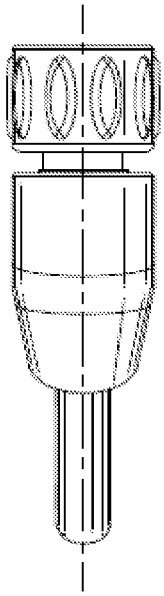
Figure 17:
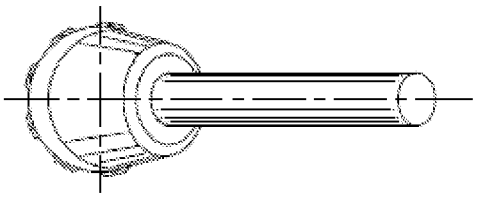
Figure 16:
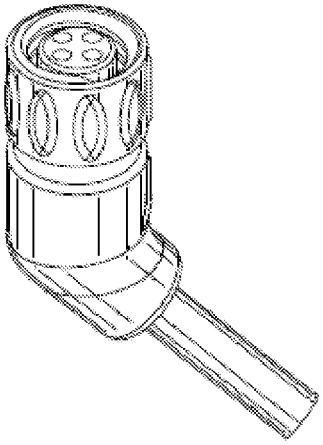
Figure 18:
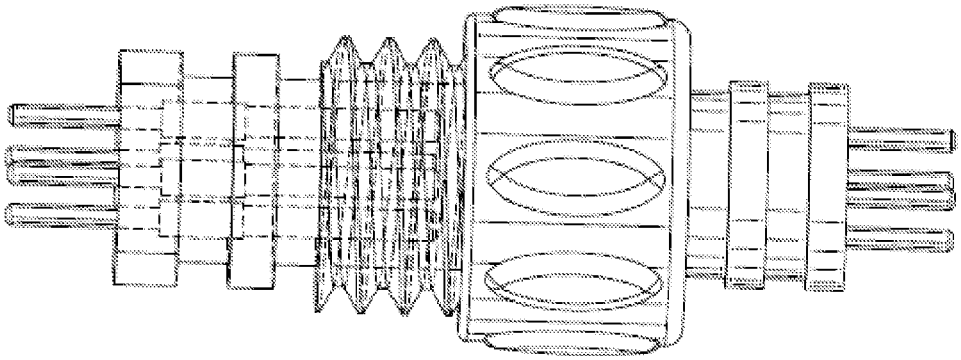
FIG. 18 is an embodiment of the canalphone coupler of FIG. 1 before the mechanical joint is engaged.
Figure 19:
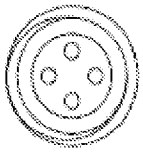
FIGS. 19-21 are male portions of an embodiment of the canalphone coupler of FIG. 1.
Figure 20:
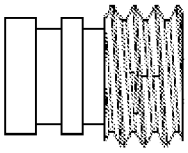
Figure 21:
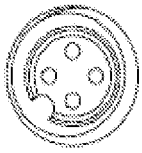
Figure 22:
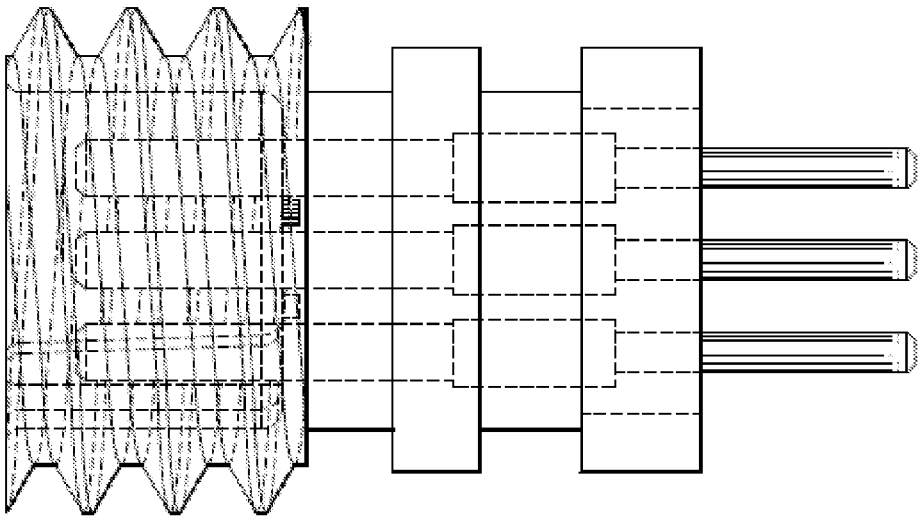
FIG. 22 is a male portion of an embodiment of the canalphone coupler of FIG. 1.
Figure 23:
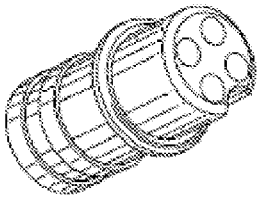
FIG. 23 is a female portion of an embodiment of the canalphone coupler of FIG. 1.
Figure 24:
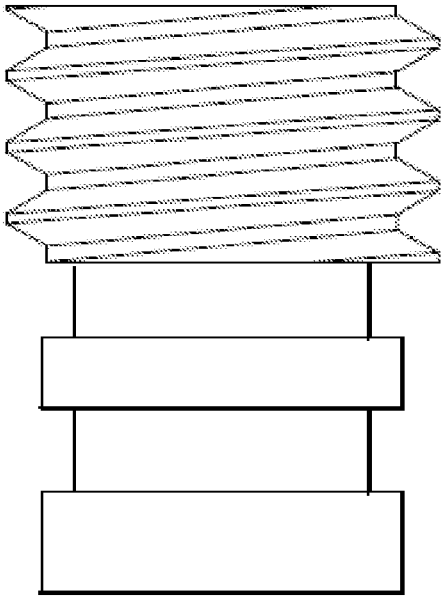
FIG. 24 is a female portion of an embodiment of the canalphone coupler of FIG. 1.
Figure 25:
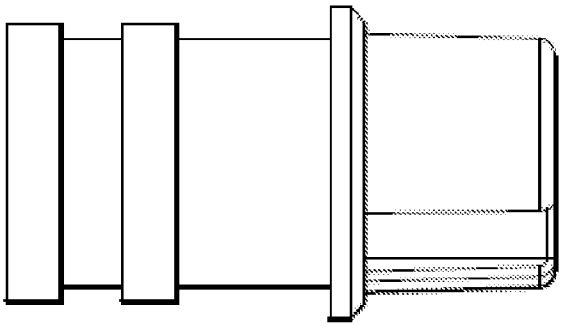
FIGS. 25-28 are female portions of an embodiment of the canalphone coupler of FIG. 1.
Figure 26:
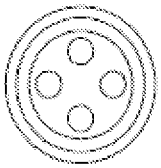
Figure 27:
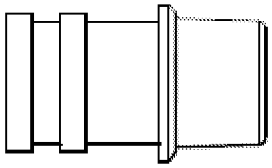
Figure 28:
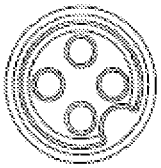
Figure 29:
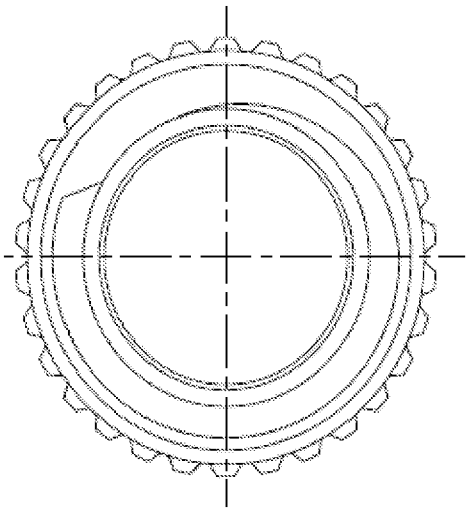
FIG. 29-30 is an embodiment of the collar of the mechanical joint of the canalphone coupler of FIG. 1.
Figure 30:
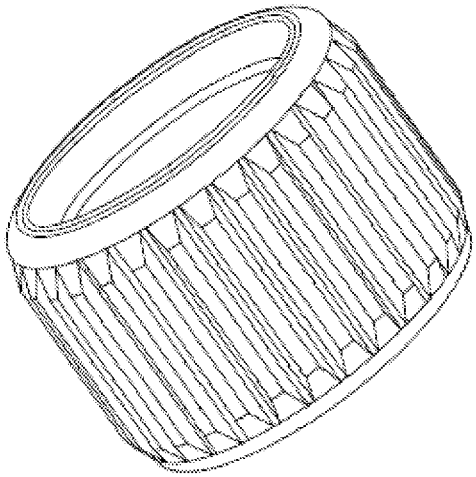
Figure 31:
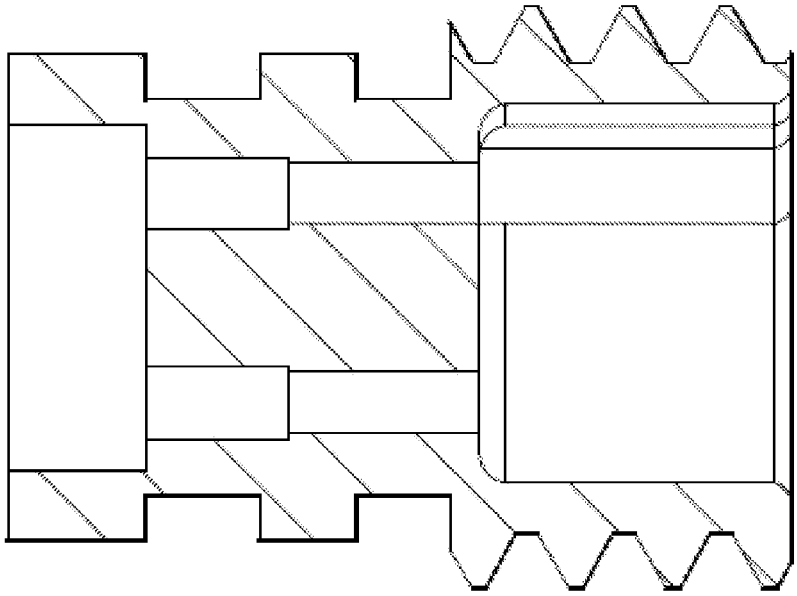
FIG. 31 is a male portion of an embodiment of the canalphone coupler of FIG. 1.
Figure 32:
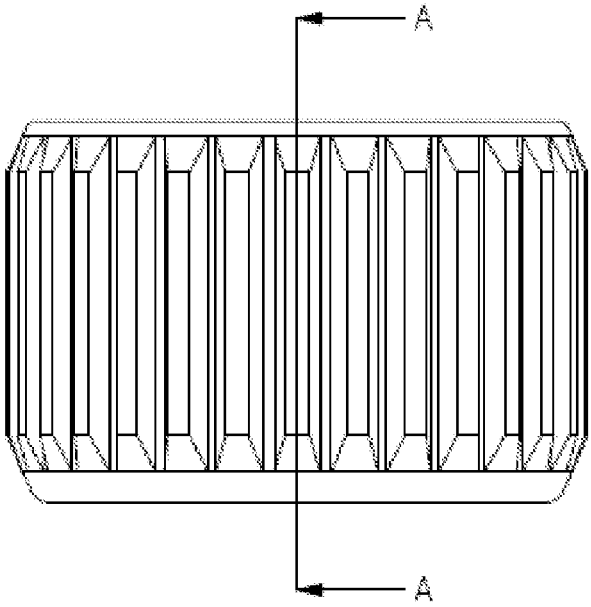
FIG. 32-33 is an embodiment of the collar of the mechanical joint of the canalphone coupler of FIG. 1.
Figure 33:
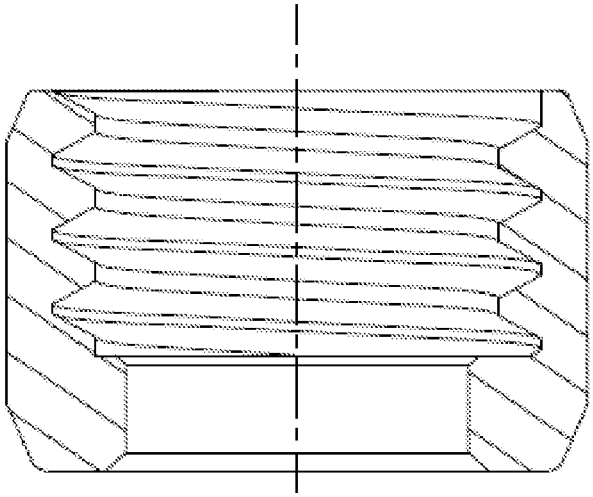

In another method embodiment, which is now described with reference to flowchart 54 of FIG. 8, the method begins at Block 56. The method may include the steps of FIG. 7 at Blocks 32, 34 and 50. The method may also include making the attenuator adjustable by the user at Block 58. The method ends at Block 60.

FIGS. 9-33 are various embodiments of the connector. The numbers cited are millimeters. The male and female portions of the connector are shown as well as such portions joined and/or about to be joined.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

The corresponding structures, materials, acts, and equivalents of all means or step plus function elements in the claims below are intended to include any structure, material, or act for performing the function in combination with other claimed elements as specifically claimed. The description of the embodiments has been presented for purposes of illustration and description, but is not intended to be exhaustive or limited to the embodiments in the form disclosed. Many modifications and variations will be apparent to those of ordinary skill in the art without departing from the scope and spirit of the embodiments. The embodiment was chosen and described in order to best explain the principles of the embodiments and the practical application, and to enable others of ordinary skill in the art to understand the various embodiments with various modifications as are suited to the particular use contemplated.

While the preferred embodiment has been described, it will be understood that those skilled in the art, both now and in the future, may make various improvements and enhancements which fall within the scope of the claims which follow. These claims should be construed to maintain the proper protection for the embodiments first described.

What is claimed is:

1. A system comprising:

a canalphone coupler comprising:

four connectors formed in a distal end thereof wherein at least two of the four connectors carry an acoustical signal and one of the four connectors comprises a ground connector, and a threaded collar movably connected to the distal end of the canalphone coupler;

a cable comprising:

four connecting portions configured to engage with the four connectors of the canalphone coupler, and a threaded portion; and a mechanical joint that joins the canalphone coupler to the cable where the mechanical joint is assembled and disassembled by a user, the mechanical joint formed by engaging the threaded collar of the canalphone coupler with the threaded portion of the cable.

2. The system of claim 1 wherein one of the four connectors comprises a low connector and at least two of the four connectors comprise a mid connector, a high connector, or a microphone connector.

3. The system of claim 2 wherein at least one of the four connectors comprises a mid connector bonded to a high connector.

4. The system of claim 2 further comprising an attenuator in communication with at least one of the low connector, a mid connector, and a high connector.

5. The system of claim 4 wherein the cable carries the attenuator and at least half of the mechanical joint.

6. The system of claim 5 wherein the attenuator is added or removed by the user.

7. The system of claim 5 wherein the attenuator is adjustable by the user.

8. The system of claim 7 wherein the attenuator is adjustable between 0-25 decibels for the low connector, and 0-15 decibels for mid and high connectors.

9. The system of claim 1 wherein the mechanical joint does not rely on any of the four connectors to join the canalphone coupler to the cable.

10. A system comprising:

a canalphone coupler comprising:

four connectors formed in a distal end thereof wherein at least two of the four connectors carry an acoustical signal, and where one of the four connectors comprises a ground connector, one of the four connectors comprises a low connector, and where at least two of the four connectors comprise a mid connector, a high connector, or a microphone connector, and a threaded collar movably connected to the distal end of the canalphone coupler;

a cable comprising:

four connecting portions configured to engage with the four connectors of the canalphone coupler, and a threaded portion;

a mechanical joint that joins the canalphone coupler to the cable where the mechanical joint is assembled and disassembled by a user, the mechanical joint formed by engaging the threaded collar of the canalphone coupler with the threaded portion of the cable; and an attenuator in communication with at least one of the low connector, a mid connector, and a high connector, wherein the attenuator is carried by the cable.

11. The system of claim 10 wherein at least one of the four connectors comprises a mid connector bonded to a high connector.

12. The system of claim 10 wherein the attenuator is added or removed by the user.

13. The system of claim 10 wherein the attenuator is adjustable by the user.

14. The system of claim 10 wherein the mechanical joint does not rely on any of the four connectors to join the canalphone coupler to the cable.

15. A system comprising:

a canalphone coupler comprising:

four connectors formed in a distal end thereof wherein at least two of the four connectors carry an acoustical signal, where one of four connectors comprises a low connector, and one of the four connectors comprises a ground connector, and a threaded collar movably connected to the distal end of the canalphone coupler;

a cable comprising:

four connection portions configured to engage with the four connectors of the canalphone coupler, and a threaded portion;

a mechanical joint that joins the canalphone coupler to the cable where the mechanical joint is assembled and disassembled by a user, the mechanical joint formed by engaging the threaded collar of the canalphone coupler with the threaded portion of the cable, wherein the mechanical joint does not rely on any of the four connectors to join the canalphone coupler to the cable; and an attenuator in communication with the low connector, wherein the attenuator is carried by the cable.

16. The system of claim 15 wherein the cable carries at least half of the mechanical joint.

* * * * *